US008439582B2

(12) United States Patent
Sato

(10) Patent No.: US 8,439,582 B2
(45) Date of Patent: May 14, 2013

(54) PRINT APPARATUS

(75) Inventor: Osamu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 264 days.

(21) Appl. No.: 13/043,947

(22) Filed: Mar. 9, 2011

(65) Prior Publication Data

US 2011/0222950 A1 Sep. 15, 2011

(30) Foreign Application Priority Data

Mar. 12, 2010 (JP) ..... 2010-055846

(51) Int. Cl.
*B41J 11/48* (2006.01)
*B41J 11/50* (2006.01)

(52) U.S. Cl.
USPC ..... 400/605; 400/607; 400/608.1; 400/608.2

(58) Field of Classification Search ..... 400/605, 400/607, 608.1, 608.2; *B41J 11/48*
See application file for complete search history.

(56) References Cited

U.S. PATENT DOCUMENTS

| | | | | | |
|---|---|---|---|---|---|
| 816,585 | A | * | 4/1906 | Kunath | 400/595 |
| 1,395,458 | A | * | 11/1921 | Stickney | 400/584 |
| 4,637,537 | A | | 1/1987 | Ikeda | |
| 4,742,946 | A | * | 5/1988 | Hamamichi et al. | 226/74 |
| 4,802,780 | A | * | 2/1989 | Yokoi | 400/643 |
| 4,815,879 | A | * | 3/1989 | Yokoi | 400/636 |
| 4,822,190 | A | * | 4/1989 | Yokoi | 400/613.3 |
| 4,822,191 | A | * | 4/1989 | Yokoi | 400/616.1 |
| 4,909,497 | A | * | 3/1990 | Itabashi et al. | 271/9.02 |
| 4,936,696 | A | * | 6/1990 | Steppe | 400/636.3 |
| 5,009,532 | A | * | 4/1991 | Akazawa et al. | 400/636.2 |
| 5,030,024 | A | * | 7/1991 | Seshimo | 400/605 |
| 5,078,525 | A | | 1/1992 | Kakuguchi | |
| 5,087,142 | A | * | 2/1992 | Suzuki et al. | 400/616 |
| 5,131,771 | A | * | 7/1992 | Kawahara | 400/605 |
| 5,199,806 | A | * | 4/1993 | Fujioka et al. | 400/616 |
| 5,221,150 | A | * | 6/1993 | Fujioka et al. | 400/616.1 |
| 5,308,175 | A | * | 5/1994 | Ito | 400/605 |
| 5,899,613 | A | * | 5/1999 | Koike et al. | 399/384 |
| 5,967,677 | A | * | 10/1999 | McCue et al. | 400/582 |

(Continued)

FOREIGN PATENT DOCUMENTS

| | | | | |
|---|---|---|---|---|
| EP | 295172 | A2 | * | 12/1988 |
| JP | 60-031984 | A | | 2/1985 |
| JP | 61121974 | A | * | 6/1986 |
| JP | 06320811 | A | * | 11/1994 |

(Continued)

OTHER PUBLICATIONS

Search Report issued May 30, 2012 in EP Application No. 11157902.5.

*Primary Examiner* — Judy Nguyen
*Assistant Examiner* — Quang X Nguyen
(74) *Attorney, Agent, or Firm* — Panitch Schwarze Belisario & Nadel LLP

(57) ABSTRACT

A print apparatus is supplied that feeds continuous paper with suppressing its swelling caused by perforations or crease. In the print apparatus, a platen is furnished opposite to a printing section; a medium support member is furnished capable of changing an interval from the platen and supports a record medium toward the platen; and a medium support auxiliary member is furnished on the opposite side to the platen in the medium support member, and when the medium support member is made to separate from the platen, the medium support auxiliary member is made to protrude from the medium support member.

4 Claims, 9 Drawing Sheets

U.S. PATENT DOCUMENTS

| | | | | |
|---|---|---|---|---|
| 7,976,232 | B2 * | 7/2011 | Eoka | 400/608.1 |
| 8,146,912 | B2 * | 4/2012 | Shimazu | 271/121 |
| 2008/0193188 | A1 * | 8/2008 | Eoka | 400/605 |
| 2011/0241277 | A1 * | 10/2011 | Kitamura | 271/10.12 |

FOREIGN PATENT DOCUMENTS

| | | | |
|---|---|---|---|
| JP | 2000-313543 | A | 11/2000 |
| JP | 2008280179 | A * | 11/2008 |

* cited by examiner

PRINT APPARATUS

FIELD OF THE INVENTION

The invention relates to a print apparatus such as a printer that performs print on a cut sheet and on a continuous paper, and the like.

BACKGROUND OF THE INVENTION

A printer as a former print apparatus comprises a platen; a movable guide that is furnished opposite to the platen through a fixed interval and capable of rotating; two pressure rollers those are supported capable of rotating by the movable guide and those press the outer surface of the platen; a push tractor that feeds a continuous paper between the platen and the movable guide; and a sheet guide that is placed above the push tractor and that feeds a cut sheet between the platen and the movable guide, when it feeds the cut sheet between the platen and the movable guide, it presses the platen through the two pressure rollers, while it makes the platen opposite to the movable guide through a fixed interval; and when it feeds the continuous paper, it makes the push tractor side of the movable guide rotate in a direction separating from the platen through a mode change lever, makes the pressure roller on the upstream side in a paper feeding direction separate from the platen by making the interval between the platen and the movable guide larger, and presses the platen through the pressure roller on the downstream side in the paper feeding direction; thus it makes possible to print on the cut sheet and on the continuous paper (for example, referring to Patent document 1).

Patent document 1: Japan Patent Publication No. 2000-313543 (paragraphs 0007-0018, FIG. 1)

In the former technology mentioned above, however, when a medium is supplied, because the interval between the platen and the movable guide is increased, in the case of a medium with perforations or a crease, especially copying paper, when a portion of the perforations or the crease goes between the platen and the movable guide, it goes into without suppressing its swelling, thus there is a problem that a load at a part of the pressure roller on the downstream side in the paper feeding direction becomes so large that it causes print failure.

SUMMARY OF THE INVENTION

It is, therefore, an object of the invention to provide a print apparatus that supplies a means to feed a medium with suppressing its swelling caused by the perforations or the crease that can solve the above problem.

That is, an aspect of the invention is to provide a print apparatus, comprising: a platen that is furnished opposite to a printing section; a medium support member that is furnished capable of changing an interval from the platen, and that supports a record medium toward the platen; and a medium support auxiliary member that is furnished on the opposite side to the platen in the medium support member, wherein the medium support auxiliary member, when the medium support member is made to separate from the platen, protrudes from the medium support member.

THE EFFECT OF THE PRESENT INVENTION

Thus, according to the present invention, it is possible to make an interval between a guide surface of the medium support auxiliary member and the outer surface of the platen narrower than an interval between a guide surface of the medium support member and the outer surface of the platen at a usual medium feeding position by making the medium support auxiliary member protrude from the guide surface of the medium support member when the medium support member is made to rotate to the medium feeding position, and such an effect is obtained that it is possible to suppress print failure by reducing a load at a part of a pressure roller on the downstream side in a medium feeding direction with suppressing swelling of perforations or a crease.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

Figure 1:
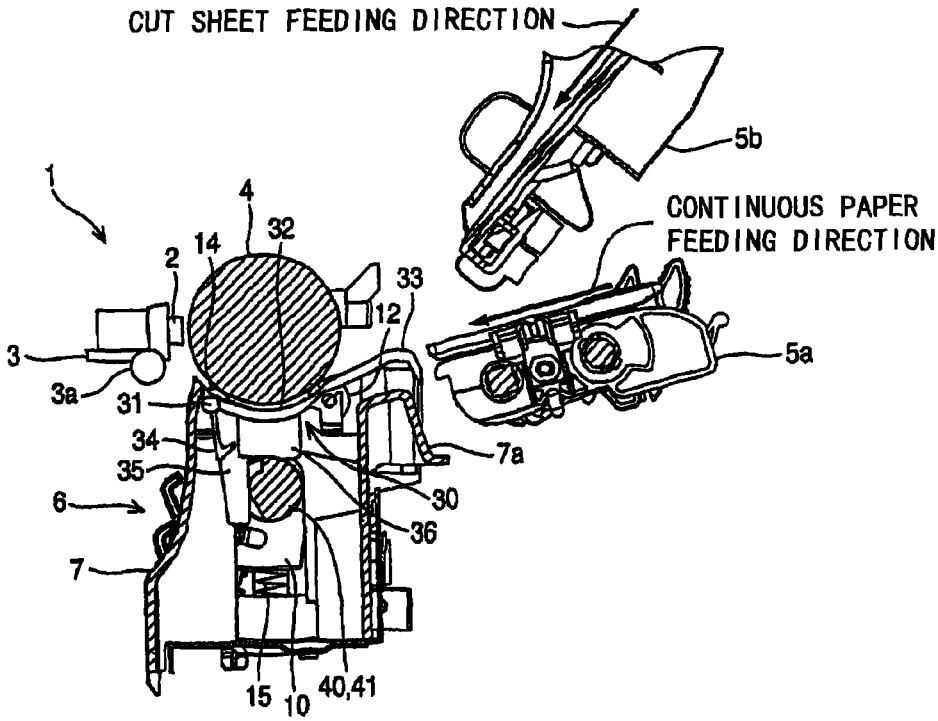
FIG. 1 is an explanation diagram showing a side of a print mechanism of embodiment 1.

A print mechanism of a printer as a print apparatus of the present embodiment is composed capable of printing on both of a cut sheet as a record medium and a continuous paper that continuously connects a plurality of paper sheets with perforations or creases (herein after: paper in the case that it is unnecessary to distinguish the cut sheet and the continuous paper), and comprises structures as shown in FIG. 1.

Figure 2:
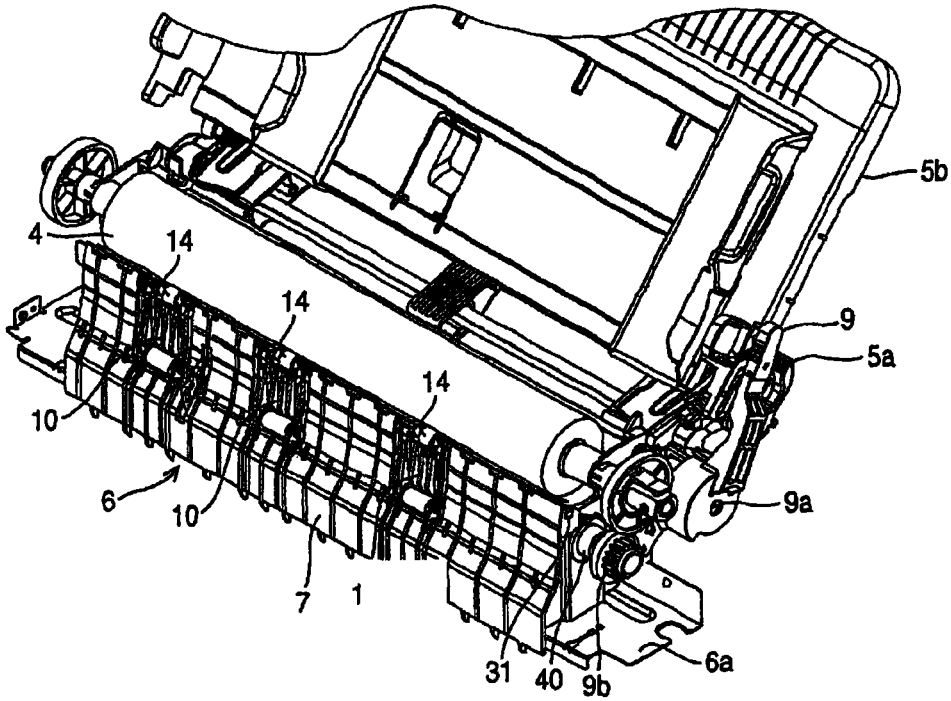
FIG. 2 is an explanation diagram showing an appearance of a print mechanism of embodiment 1.

In FIG. 1 and FIG. 2, 1 is a printing section of the print mechanism, comprises a print head 2 that furnishes a plurality of print pins per dot those are composed of super steel wire, a career 3 that mounts the print head 2 and that is formed capable of reciprocating on a career rail 3*a* placed in a direction perpendicular to a paper feeding direction (referring to FIG. 8 and FIG. 12, a direction that winds paper around a platen 4 in a clockwise direction from the right side in FIG. 1), and the like, and is placed opposite to the front side (the left side in FIG. 1) of the platen 4.

Moreover, the supply of paper for print use to the printing section 1 of the present embodiment is performed from the rear side (the right side in FIG. 1).

The platen 4 is supported capable of rotating by a main frame of the printer (not shown), and has a function to generate sufficient transfer power onto paper by stopping stroke of the print pins in the print head 2.

5*a* is a push tractor, in which a plurality of sprocket pins erected on the outside of a belt that rotates through a driving means such as motor and the like (not shown) is furnished, and by fitting the sprocket pins into sprocket holes furnished at the side edge parts of the both sides along the paper feeding direction of the continuous paper, it becomes possible to convey the continuous paper in a direction of the platen 4, that is, a continuous paper feeding direction.

5*b* is a sheet guide, is attached to an up cover (not shown) of the printer and is placed above the push tractor 5*a*, in which the cut sheet is made to drop to the direction of the platen 4, that is, a cut sheet feeding direction owing to its weight.

Figure 3:
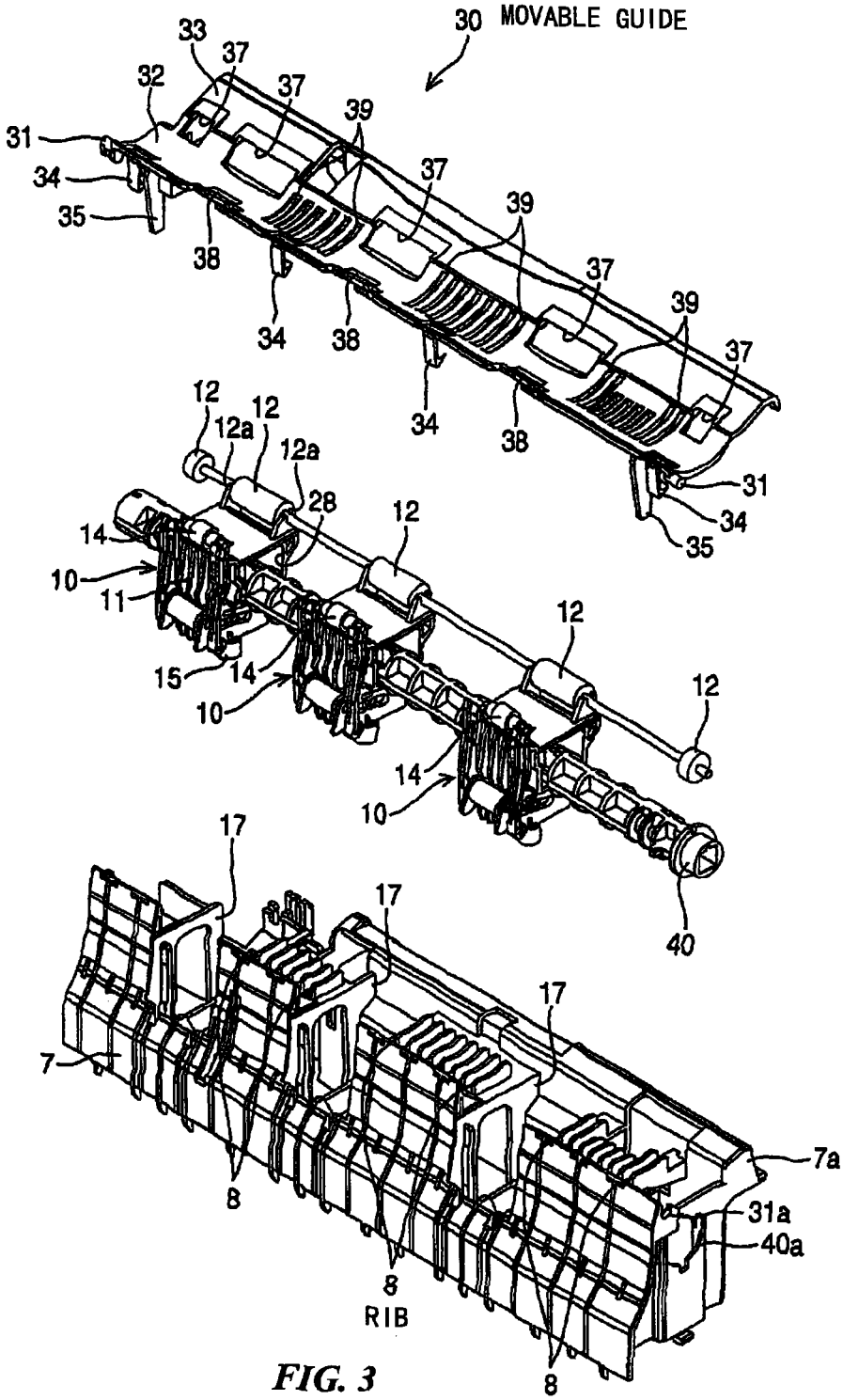
FIG. 3 is an explanation diagram showing a structure of a paper guide assembly of embodiment 1.

6 is a paper guide assembly, is placed below the platen 4 by being fixed on the main frame through a lower beam 6*a*, and to whose paper guide body 7, as shown in FIG. 3, a roller assembly 10 for paper conveyance use, a movable guide 30 as a medium support member that forms a paper conveyance route between the platen 4, a camshaft 40 that switches a paper feeding mode of paper to feed, and the like are attached.

Figure 4:
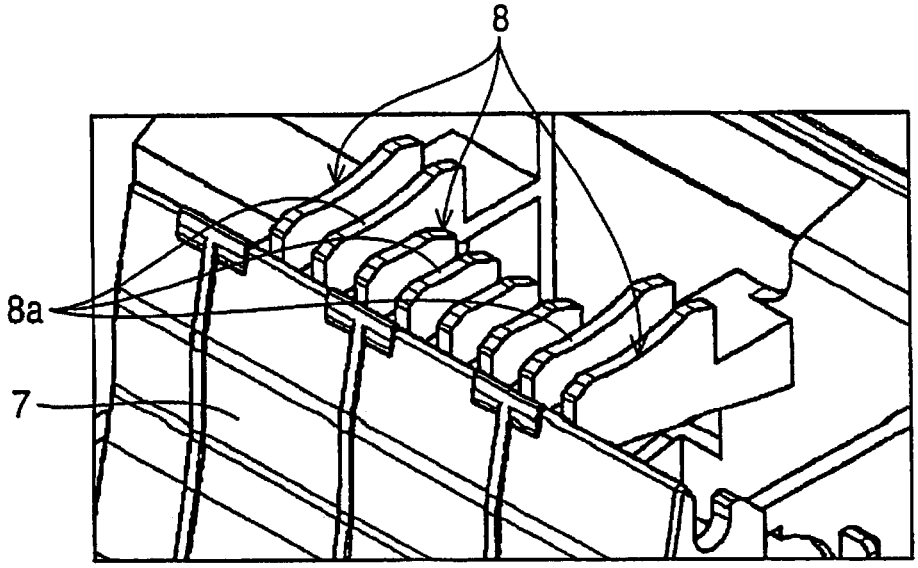
FIG. 4 is an explanation diagram showing an appearance of a guide rib of embodiment 1.
Figure 5:
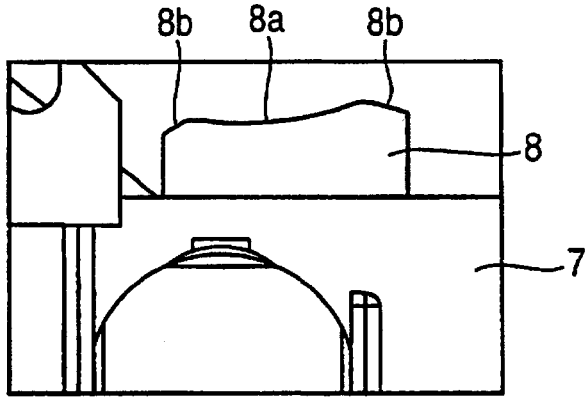
FIG. 5 is an explanation diagram showing a side of a guide rib of embodiment 1.

Further, a stopper portion 7*a* is furnished on the push tractor 5*a* side above the paper guide body 7, above which, on the opposite side across the platen 4 and the movable guide 30, a plurality of guide ribs 8 as medium support auxiliary members are furnished (referring to FIG. 3), and in the guide rib 8, as shown in FIG. 4, a guide surface 8*a* on the platen 4 side becomes an R convex shape in a direction separating from the platen 4 in order not to be a load in paper conveyance time, further, at the corner of the R shape, a chamfered shape 8*b* is made in order not to catch paper (referring to FIG. 5).

9 is a mode switch lever, is a lever that is operated when a paper feeding mode is switched, as shown in FIG. 2, is supported capable of rotating around a fulcrum hole 9*a* in which a fulcrum axle of a main frame (not shown) is fit, moves in response to the movement of a mode change gear 9*b* attached to the tip part of the camshaft 40 through a gear line (not shown), and has a function to switch the paper feeding mode into a cut sheet mode that serves a kind of fed paper as a cut sheet and into a continuous paper mode that serves it as a continuous paper by making the mode switch lever 9 rotate to the rear side or the front side and making the camshaft 40 rotate through the mode switch gear 9*b*, In the roller assembly 10, a first pressure roller 12 that is supported capable of rotating by a bearing portion 12*a* erected on a top plate 11*a* of a roller frame 11, a second pressure roller 14 that is supported capable of rotating on the upper part of a roller holder 13 (referring to FIG. 6), a first spring member 15 such as a compression coil spring and the like, and the like are assembled, and on the condition that they are impelled in the direction of the platen 4 through the first spring member 15, they are accommodated capable of up-and-down moving in an accommodation hole 17 furnished on the paper guide body 7 (referring to FIG. 3).

Figure 6:
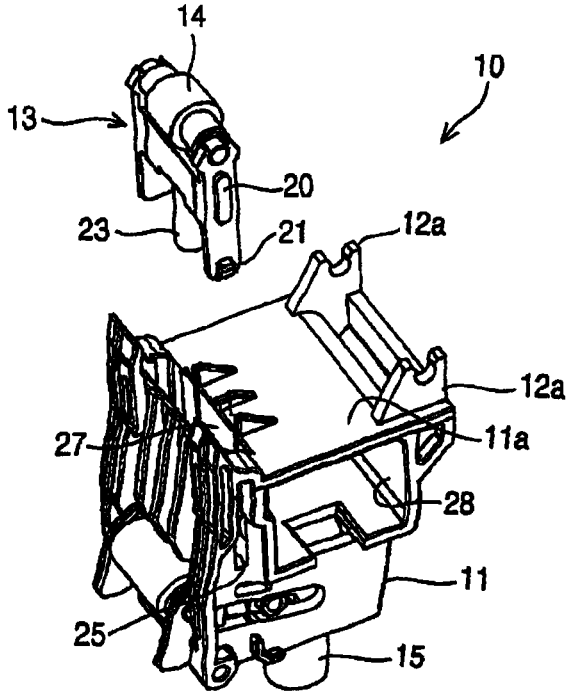
FIG. 6 is an explanation diagram showing a structure of a roller assembly of embodiment 1.
Figure 9:
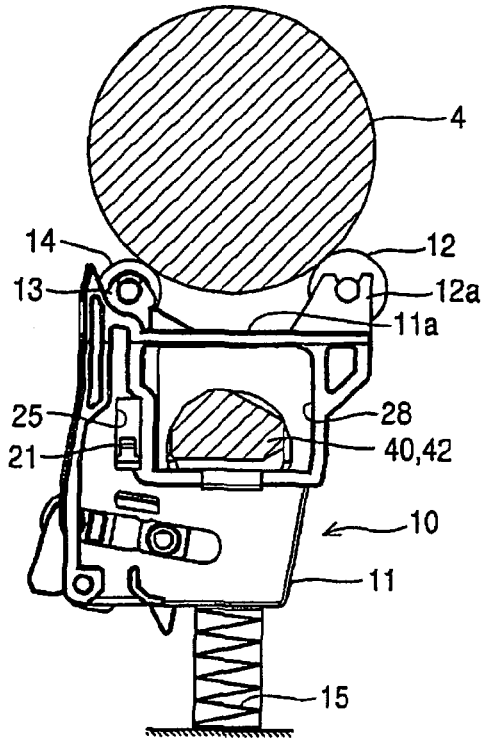
FIG. 9 is an explanation diagram showing a side of a roller assembly in a cut sheet mode of embodiment 1.
Figure 13:
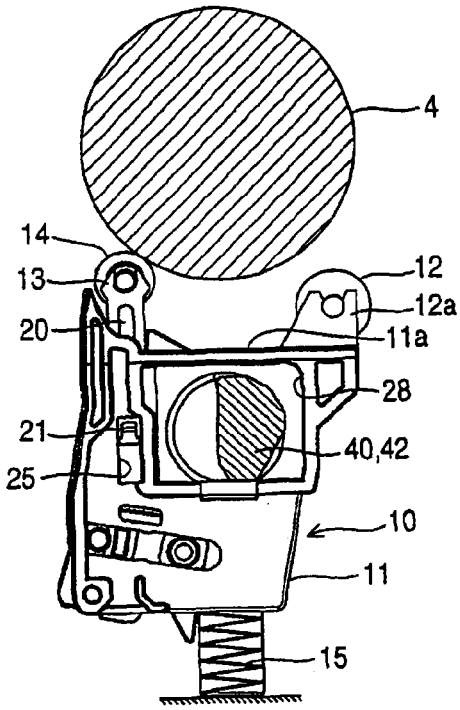
FIG. 13 is an explanation diagram showing a side of a roller assembly in a continuous paper mode of embodiment 1.

The roller holder 13, as shown in FIG. 6, on whose both sides an oval-shaped projecting portion 20 is furnished and on whose lower part a claw portion 21 is furnished, and a second spring member 23 such as a compression coil spring and the like is furnished on the lower part of the roller holder 13, is inserted in a holder hole 27 by fitting the projecting portion 20 into a rectangular fitting ditch (not shown) furnished on the roller frame 11 and engaging the claw portion 21 with a rectangular engagement hole 25 furnished on the roller frame 11 (referring to FIG. 9 and FIG. 13).

Further, in the roller frame 11, a rectangular insertion hole 28 in which the camshaft 40 is inserted is furnished.

The movable guide 30 is, as shown in FIG. 3, a plate-like member in that a fulcrum axle 31 furnished on its both sides of the downstream side in the paper feeding direction is fit into a fulcrum hole 31*a* furnished on the paper guide body 7 and that is supported capable of rotating around the fulcrum axle 31, its guide surface 32 on the platen 4 side is formed into an R convex shape in a direction separating from the platen 4, and a guide portion 33 that guides paper in paper feeding time is furnished on the upstream side of the guide surface 32, that is attached to the upper part, that is, the platen 4 side of the paper guide body 7 by engaging a hook portion 34 furnished on the end of the downstream side in the paper feeding direction with a rib (not shown) furnished on the paper guide body 7.

Further, on the surface of the opposite side to the guide surface 32 of the movable guide 30, a lever portion 35 for making the movable guide 30 rotate to a continuous paper feeding position (referring to FIG. 12) is furnished on the both sides of its end of the downstream side in the paper feeding direction, and a positioning projection 36 for positioning the movable guide 30 on a cut sheet feeding position (referring to FIG. 8) is furnished on the upstream side of the lever portion 35.

Furthermore, on the guide surface 32, a window portion 37 that makes the first pressure roller 12 protrude is furnished on the upstream side, a notch portion 38 that makes the second pressure roller 14 protrude is furnished on the downstream side, and in a center part, a plurality of slits 39 are formed as apertures that make the guide rib furnished on the paper guide body 7 protrude when the movable guide 30 rotates to the continuous paper feeding position.

The camshaft 40, as shown in FIG. 2, is supported capable of rotating by a bearing portion 40*a* (referring to FIG. 3) furnished on a center part of the both sides of the paper guide body 7, and is attached to the paper guide body 7 on the condition that it is inserted into the insertion hole 28 of the roller assembly 10 accommodated in the accommodation hole 17.

Figure 7:
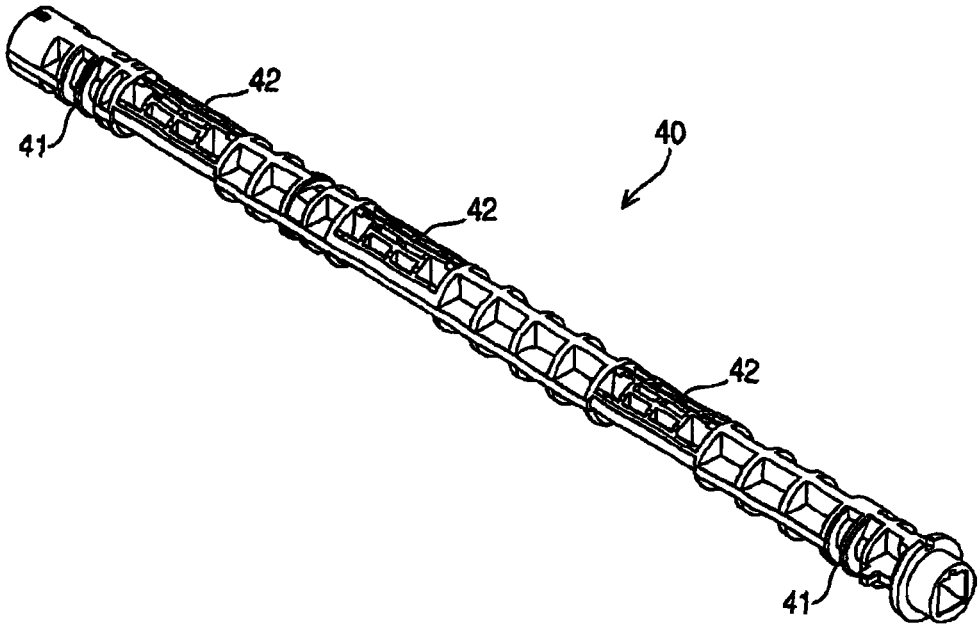
FIG. 7 is an explanation diagram showing an appearance of a camshaft of embodiment 1.

Further, on the both ends of an axle direction of the camshaft 40, as shown in FIG. 7, a first cam 41 (referring to FIG. 8) that makes the movable guide 30 rotate to the cut sheet feeding position and the continuous paper feeding position, and a second cam 42 (referring to FIG. 13) that puts the roller assembly 10 down against impellent force of the first spring member 15 when it makes the movable guide 30 rotate from the cut sheet feeding position to the continuous paper feeding position, are formed.

It is to explain about the function of the structure mentioned above.

In the case to switch into the cut sheet mode that serves a kind of fed paper as a cut sheet from the condition of the continuous paper mode, by making the mode switch lever 9 rotate to the rear side, the mode switch gear 9*b* is made to rotate to a counterclockwise direction when viewed from the right side of FIG. 2.

Figure 8:
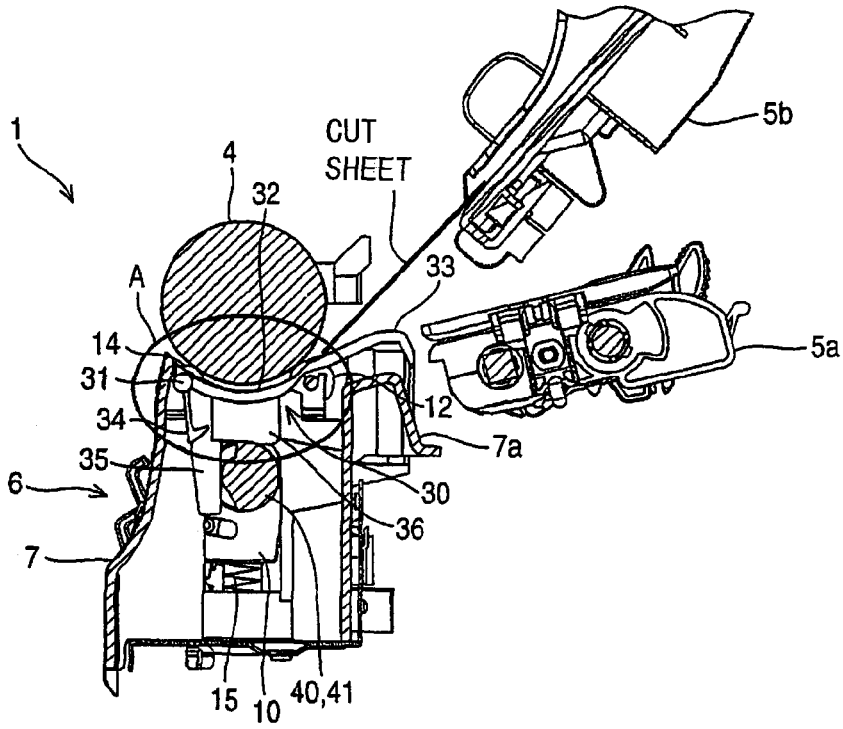
FIG. 8 is an explanation diagram showing a side of a print mechanism in a cut sheet mode of embodiment 1.

At this time, the first cam 41 in the camshaft 40, as shown in FIG. 8, pushes the positioning projection 36 up through its circular surface, and makes the movable guide 30 locate on the cut sheet feeding position owing to its weight by making it rotate around the fulcrum axle 31 in a counterclockwise direction in FIG. 8.

At the same time, the second cam 42 is, as shown in FIG. 9, on a position separated from the base of the insertion hole 28, the roller assembly 10 is pushed up in the direction of the platen 4 through the first spring member 15, and the first pressure roller 12 presses the outer surface of the platen 4.

At this time, the second pressure roller 14, because the claw portion 21 of the roller holder 13 does not reach to the end surface on the platen 4 side of the engagement hole 25, presses the outer surface of the platen 4 through the impellent force of the second spring member 23 (referring to FIG. 9).

Figure 10:
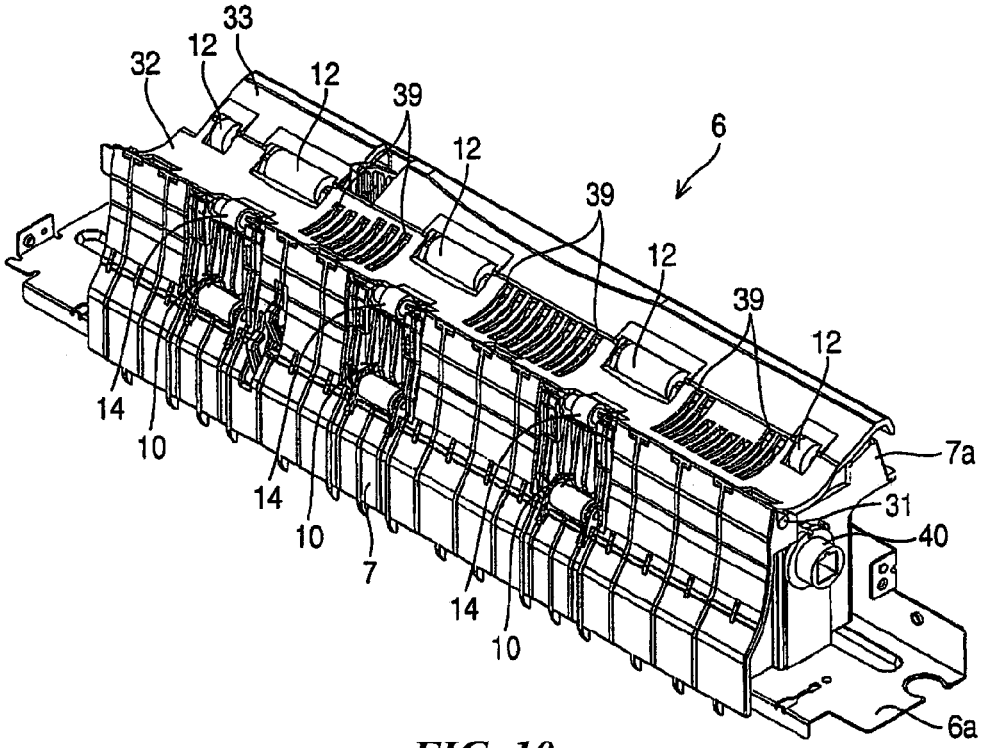
FIG. 10 is an explanation diagram showing an appearance of a paper guide assembly in a cut sheet mode of embodiment 1.
Figure 11:
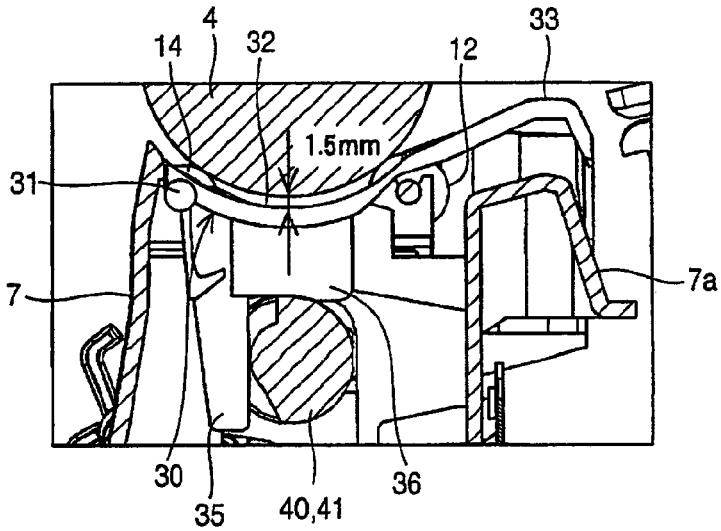
FIG. 11 is an enlargement diagram of an A part of FIG. 8.

According to the operation of the respective parts mentioned above, the guide rib 8 furnished on the paper guide body 7, as shown in FIG. 10, becomes hidden in the slit 39, and intervals between the outer surface of the platen 4 and the guide surface 32 of the movable guide 30, as shown in FIG. 11, become the same as a fixed interval (in the present embodiment, 1.5 mm).

Then, as shown in FIG. 8, the cut sheet fed from the sheet guide 5*b* owing to its weight is caught by the guide portion 33, is guided to between the platen 4 and the first pressure roller 12, and is guided through the outer surface of the platen 4 and the guide surface 32 of the movable guide 30 to be conveyed in the paper feeding direction, and when the cut sheet is stopped on a fixed print position, print operation is performed through the print head 2 of the printing section 1.

In the case to switch into the continuous paper mode that serves a kind of fed paper as a continuous paper from the condition of the cut sheet mode, by making the mode switch lever 9 rotate to the front side, the mode switch gear 9*b* is made to rotate to a clockwise direction when viewed from the right side of FIG. 2.

Figure 12:
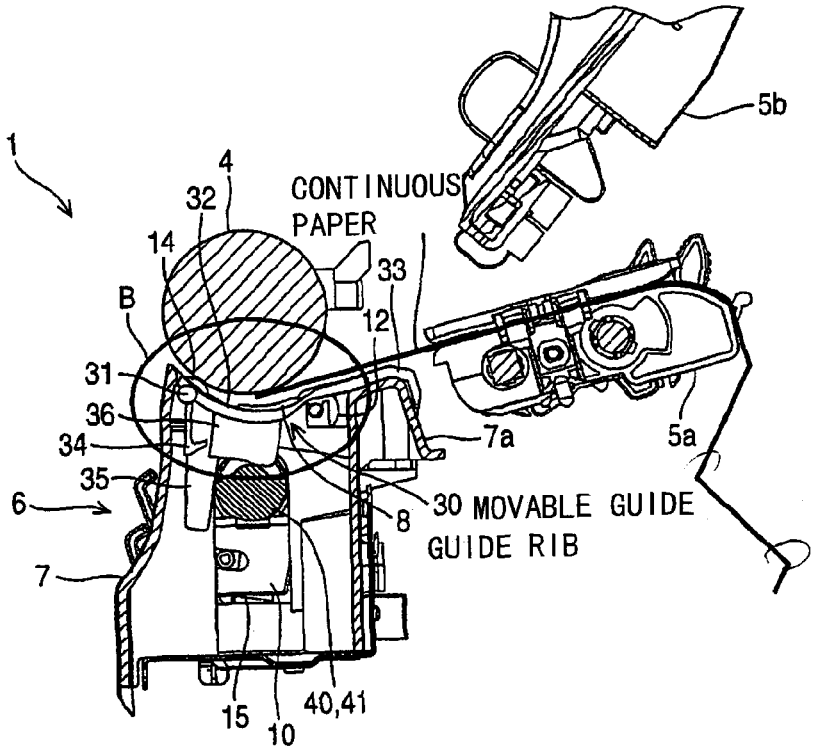
FIG. 12 is an explanation diagram showing a side of a print mechanism in a continuous paper mode of embodiment 1.

At this time, the first cam 41 in the camshaft 40 releases the pushing up to the positioning projection 36 by rotating in a clockwise direction in FIG. 12; makes the movable guide 30 rotate around the fulcrum axle in the clockwise direction in FIG. 12 by pressing the lever portion 35 through its circular surface; stops the guide portion 33 by the stopper portion 7*a* furnished on the paper guide body 7 owing to its weight; and makes the movable guide 30 locate on the continuous paper feeding position.

At the same time, the second cam 42, as shown in FIG. 13, presses the base of the insertion hole 28 on the cam surface, pushes the roller assembly 10 down in a direction separating from the platen 4 against the impellent force of the first spring member 15, and makes the first pressure roller 12 separate from the outer surface of the platen 4.

At this time, the second pressure roller 14, because the claw portion 21 of the roller holder 13 does not reach to the end surface on the platen 4 side of the engagement hole 25, presses the outer surface of the platen 4 through the impellent force of the second spring member 23 (referring to FIG. 13).

Figure 14:
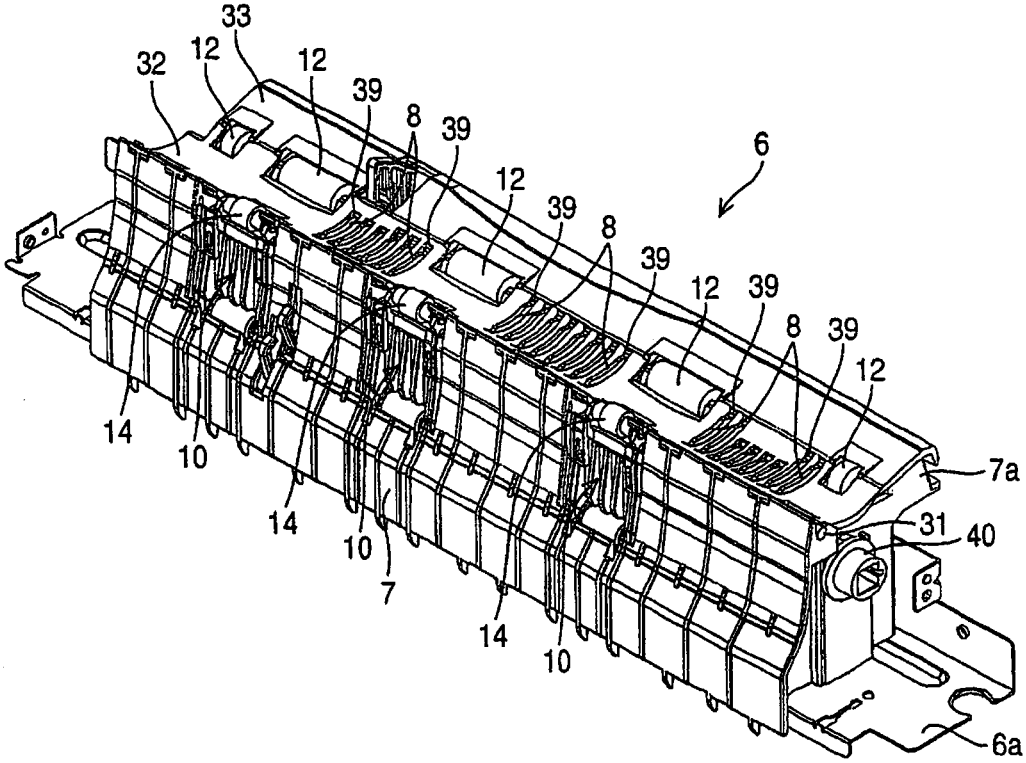
FIG. 14 is an explanation diagram showing an appearance of a paper guide assembly in a continuous paper mode of embodiment 1.
Figure 15:
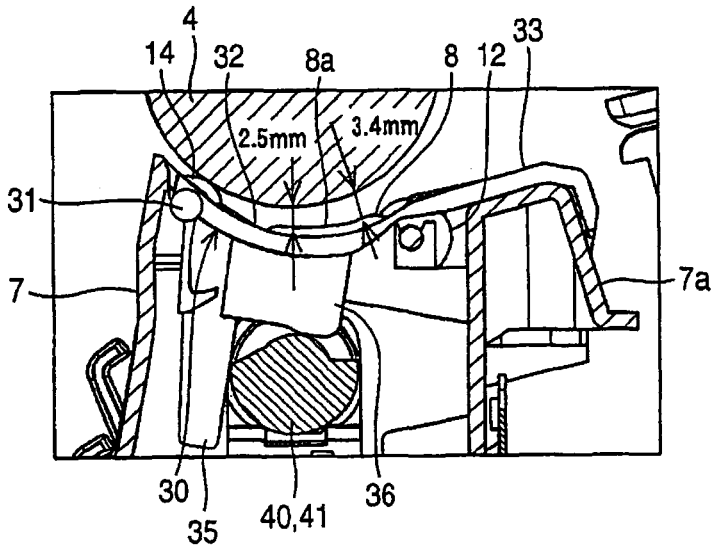
FIG. 15 is an enlargement diagram of a B part of FIG. 12.

According to the operation of the respective parts mentioned above, the guide rib 8 furnished on the paper guide body 7, as shown in FIG. 14, becomes protruded from the slit 39, and the interval between the outer surface of the platen 4 and the guide surface 8*a* of the guide rib 8, as shown in FIG. 15, becomes an enlarging interval toward the upstream side in the paper feeding direction (in the present embodiment, enlarging from 2.5 mm to 3.4 mm).

Then, as shown in FIG. 12, the continuous paper conveyed through the sprocket pins from the push tractor 5*a* is guided to the guide portion 33, is guided to between the platen 4 and the separated first pressure roller 12, and is conveyed in the paper feeding direction with being suppressed its swelling caused by the perforations or the crease through being guided through the outer surface of the platen 4 and the guide surface 8*a* of the guide rib 8, and by passing the pressing portion through the second pressure roller 14, when the first paper sheet of the continuous paper is stopped at a fixed print position, print operation is started through the print head 2 of the printing section 1, and the continuous print operation is performed with transmitting paper in order.

As explained above, in the present embodiment, it is possible to make the interval between the guide surface of the guide rib and the outer surface of the platen narrower than the interval between the guide surface of the movable guide and the outer surface of the platen at the usual continuous paper feeding position by making the guide rib protrude from the guide surface of the movable guide when the movable guide is made to rotate to the continuous paper feeding position, and it is possible to suppress print failure by reducing the load at a part of the second pressure roller with suppressing the swelling of the perforations or the crease.

Embodiment 2

Hereinafter, it is to explain about the printer of the present embodiment by using FIG. 16 and FIG. 17.

Moreover, with respect to the same parts as those of embodiment 1 mentioned above, the explanation is omitted by assigning the same mark.

Figure 16:
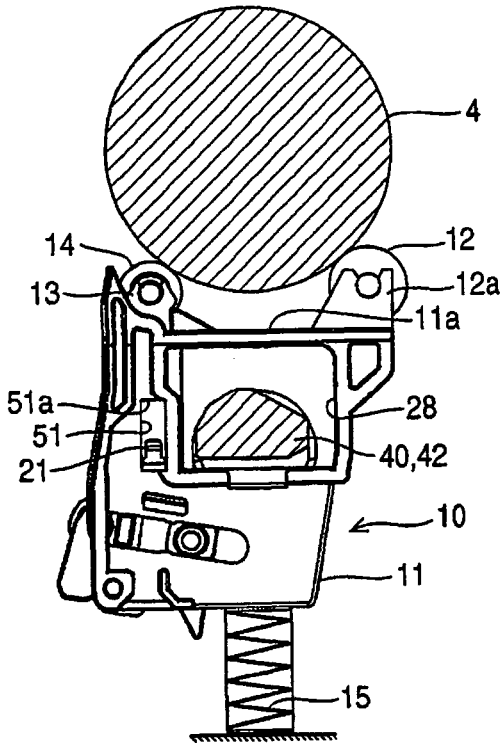
FIG. 16 is an explanation diagram showing a side of a roller assembly in a cut sheet mode of embodiment 2.
Figure 17:
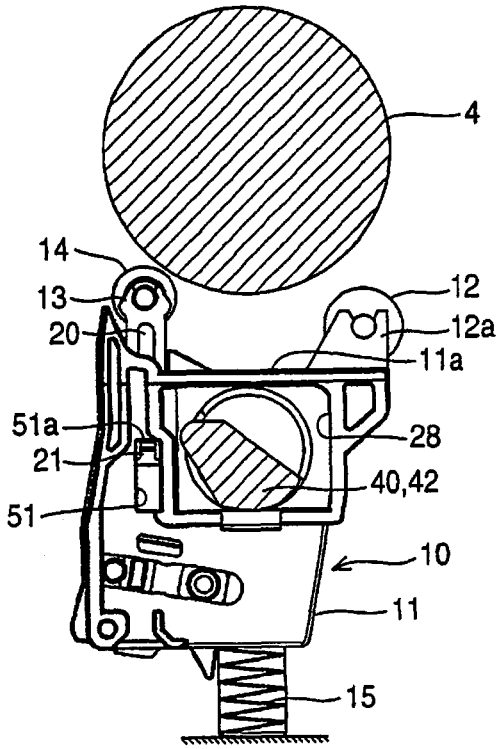
FIG. 17 is an explanation diagram showing a side of a roller assembly in a continuous paper mode of embodiment 2.

With respect to the roller assembly 10 of the present embodiment, as shown in FIG. 16 and FIG. 17, on whose both sides an oval-shaped projecting portion 20 is furnished and on whose lower part a claw portion 21 is furnished, similarly to embodiment 1 mentioned above, although a shape of a rectangular engagement hole 51 to engage the claw portion 21 furnished on the roller frame 11 is different.

That is, the end surface 51*a* on the platen 4 side of the engagement hole 51 of the present embodiment is formed at a position where the claw portion 21 of the roller holder 13 is engaged with the engagement hole 51 on the way during the roller assembly 10 is pushed down in a direction separating from the platen 4 through the second cam 42 in the time to switch from the cut sheet mode to the continuous paper mode.

It is to explain about the function of the structure mentioned above.

Because the operation of the respective parts in switch time to the cut sheet mode of the present embodiment is the same as that of embodiment 1 mentioned above, its explanation is omitted.

At this time, as shown in FIG. 16, the second pressure roller 14, because the claw portion 21 of the roller holder 13 does not reach to the end surface 51*a* on the platen 4 side of the engagement hole 51, presses the outer surface of the platen 4 through the impellent force of the second spring member 23.

In the case to switch into the continuous paper mode that serves a kind of fed paper as a continuous paper from the condition of the cut sheet mode, by making the mode switch lever 9 rotate to the front side and making the mode change gear 9*b* rotate similarly to embodiment 1 mentioned above, the first cam 41 in the camshaft 40 releases the pushing up to the positioning projection 36; and by pressing the lever portion 35 through its circular surface, making the movable guide rotate around the fulcrum axle 31 similarly to embodiment 1, and stopping the guide portion 33 by the stopper portion 7*a* furnished on the paper guide body 7 owing to its weight, makes the movable guide 30 locate on the continuous paper feeding position (referring to FIG. 12).

At the same time, the second cam 42, as shown in FIG. 17, presses the base of the insertion hole 28 through the cam surface, pushes the roller assembly 10 down in a direction separating from the platen 4 against the impellent force of the first spring member 15, and makes the first pressure roller 12 separate from the outer surface of the platen 4.

On the way of the descent of the roller assembly 10, the claw portion 21 of the roller holder 13 is engaged with the end surface 51*a* of the platen 4 side of the engagement hole 51, the roller holder 13 descends with the descent of the roller assembly 10, and the second pressure roller 14 attached to this is made to separate from the outer surface of the platen 4 (referring to FIG. 17).

According to the operation of the respective parts mentioned above, the guide rib 8 furnished on the paper guide body 7 becomes protruded from the slit 39 similarly to embodiment 1 (referring to FIG. 14), and the interval between the outer surface of the platen 4 and the guide surface 8*a* of the guide rib 8 becomes an enlarging interval toward the upstream side in the paper feeding direction (referring to FIG. 15).

Then, the continuous paper conveyed through the sprocket pins from the push tractor 5*a* is guided to the guide portion 33 similarly to embodiment 1 (referring to FIG. 12), is guided to between the platen 4 and the separated first pressure roller 12, and is conveyed in the paper feeding direction with being suppressed its swelling caused by the perforations or the crease through being guided by the outer surface of the platen 4 and the guide surface 8*a* of the guide rib 8, and by passing the pressing portion through the separated second pressure roller 14, when the first paper sheet of the continuous paper is stopped at a fixed print position, print operation is started through the print head 2 of the printing section 1, and the continuous print operation is performed with transmitting paper in order.

As explained above, in the present embodiment, adding to the similar effect to embodiment 1 mentioned above, because the second pressure roller is made to separate from the outer surface of the platen in print time on the continuous paper, it is possible to further reduce the load of the conveyed continuous paper at a part of the second pressure roller with suppressing the swelling of the perforations or the crease through the guide surface of the guide rib and the outer surface of the platen, and it is possible to further suppress print failure.

Moreover, in respective embodiments mentioned above, it is to explain that the printing section of the print apparatus is a printer comprising a print head that has print pins. However, the print apparatus is not limited to the foregoing embodiments, but may be a printer comprising a print head of ink jet type, may also be a printer of electrographic type and the like. What is important is that it is possible to be applied if it is a print apparatus of a printer and the like that performs print by switching a paper feeding route of the cut sheet and a paper feeding route of the continuous paper.

The present invention is not limited to the foregoing embodiments but many modifications and variations are possible within the spirit and scope of the appended claims of the invention.

What is claimed is:

1. A print apparatus, comprising:

a platen that is furnished opposite to a printing section;

a medium support member that is furnished capable of changing an interval from the platen, and that supports a record medium toward the platen;

a medium support auxiliary member that is furnished on the opposite side to the platen in the medium support member, wherein the medium support auxiliary member, when the medium support member is made to separate from the platen, protrudes from the medium support member;

a cut sheet supplying section that supplies a cut sheet record medium as the record medium;

a continuous medium supplying section that supplies a continuous record medium that is longer than the cut sheet record medium in a medium conveyance direction as the record medium;

wherein the cut sheet supplying section is placed above the continuous medium supplying section;

the medium support member, when the cut sheet record medium is supplied, moves to the platen side, and when the continuous record medium is supplied, moves to a direction separating from the platen;

the medium support auxiliary member, when the continuous record medium is supplied, protrudes from an aperture that exists in the medium support member, and when the cut sheet record medium is supplied, decreases its protrusion from the medium support member;

wherein the medium support auxiliary member is extended in the medium conveyance direction and has edge portions that touch the conveyed medium, and the edge portions are plurally arranged in a direction across the medium conveyance direction;

a plurality of first pressure rollers on an upstream side in the medium conveyance direction of the medium support member, wherein the plurality of the first pressure rollers are plurally arranged in a direction across the medium conveyance direction; and a part of edge portions those exist in the medium support auxiliary member is placed between the plurally arranged first pressure rollers.

2. The print apparatus according to claim 1, wherein the record medium is kept on a folded state on an upstream side in a medium conveyance direction of the platen.

3. The print apparatus according to claim 2, wherein the record medium, before entered apparatus body, is kept on a state that a crease is extended in a direction across the medium conveyance direction of the platen.

4. The print apparatus according to claim 3, wherein the crease has perforations.

* * * * *